US008104646B2

(12) United States Patent
Foster et al.

(10) Patent No.: US 8,104,646 B2
(45) Date of Patent: Jan. 31, 2012

(54) TRIGGER SPRAYER HAVING A REDUCED NUMBER OF PARTS AND A DOUBLE TUBULAR VALVE MEMBER

(75) Inventors: Donald D. Foster, St. Charles, MO (US); Philip L. Nelson, Wildwood, MO (US)

(73) Assignee: MeadWestvaco Calmar, Inc., Grandview, MO (US)

( * ) Notice: Subject to any disclaimer, the term of this patent is extended or adjusted under 35 U.S.C. 154(b) by 835 days.

(21) Appl. No.: 12/139,815

(22) Filed: Jun. 16, 2008

(65) Prior Publication Data

US 2009/0308897 A1 Dec. 17, 2009

(51) Int. Cl.
*B67D 7/58* (2010.01)

(52) U.S. Cl. ..... 222/383.1; 222/340; 239/333

(58) Field of Classification Search ..... 222/209, 222/340, 380, 382, 383.1, 563; 137/854; 239/333

See application file for complete search history.

(56) References Cited

U.S. PATENT DOCUMENTS

| | | | | | |
|---|---|---|---|---|---|
| 3,752,366 | A * | 8/1973 | Lawrence, Jr. | ..... | 222/207 |
| 3,987,938 | A * | 10/1976 | Cooprider et al. | ..... | 222/209 |
| 4,618,077 | A * | 10/1986 | Corsette | ..... | 222/383.1 |
| 5,465,857 | A * | 11/1995 | Yang | ..... | 215/228 |
| 5,615,835 | A * | 4/1997 | Nelson | ..... | 239/333 |
| 5,984,149 | A * | 11/1999 | Thanisch et al. | ..... | 222/340 |
| 7,182,093 | B2 * | 2/2007 | Call et al. | ..... | 137/15.18 |

* cited by examiner

*Primary Examiner* — Kevin P Shaver
*Assistant Examiner* — Andrew Bainbridge
(74) *Attorney, Agent, or Firm* — MWV Intellectual Property Group

(57) ABSTRACT

A trigger sprayer has a one piece valve member that includes both an inlet valve element and an outlet valve element. The one piece valve member replaces the separate liquid inlet valve and liquid outlet valve of a conventional trigger sprayer, and thereby provides a more simplified construction for the trigger sprayer and a fewer number of component parts in the trigger sprayer.

25 Claims, 1 Drawing Sheet

TRIGGER SPRAYER HAVING A REDUCED NUMBER OF PARTS AND A DOUBLE TUBULAR VALVE MEMBER

BACKGROUND OF THE INVENTION

1. Field of the Invention

The present invention pertains to the construction of a trigger sprayer in which all of the component parts are made of plastic and the number of component parts is reduced, thereby reducing the construction cost of the trigger sprayer. In particular, the present invention pertains to a trigger sprayer that replaces the separate liquid inlet and liquid outlet valves of conventional trigger sprayers with a single valve member having an inlet valve element and an outlet valve element positioned inside the pump chamber of the trigger sprayer. The trigger sprayer eliminates the metal coil spring and the separate liquid spinner of conventional trigger sprayers, giving it an eight piece construction.

2. Description of the Related Art

Handheld and hand operated liquid dispensers known as trigger sprayers are used to dispense liquid products, such as cleaning liquids. A trigger sprayer is typically connected to a bottle containing the liquid. The liquid is dispensed from the bottle by manual operation of the trigger sprayer.

The typical construction of a trigger sprayer includes a sprayer housing that is connected to the neck of the bottle. The sprayer housing is typically connected to the bottle neck by a threaded connection or a bayonet-type connection. The sprayer housing is molded of plastic and is formed with a pump chamber, a liquid supply passage communicating with the pump chamber, and a liquid discharge passage communicating with the pump chamber. A pump chamber opening on the exterior of the sprayer housing provides access to the pump chamber interior. A liquid supply opening on the exterior of the sprayer housing communicates through the liquid supply passage with the pump chamber interior. A liquid discharge opening on the exterior of the sprayer housing communicates through the liquid discharge passage with the pump chamber interior.

A dip tube is connected to the sprayer housing at the liquid supply opening. The dip tube extends into the liquid contained in the bottle when the sprayer housing is attached to the bottle. The dip tube communicates the liquid in the bottle with the liquid supply passage in the sprayer housing and with the interior of the pump chamber.

A nozzle assembly is assembled to the sprayer housing at the liquid outlet opening. Some nozzle assemblies include features that enable the adjustment of the pattern of the liquid discharged from the trigger sprayer. For example, a nozzle assembly that includes a separate liquid spinner and a rotatable nozzle cap that can be adjusted between an "off" position where discharge from the trigger sprayer is prevented, and one or more "on" positions where liquid discharge from the trigger sprayer is permitted, and the liquid discharge can be adjusted between a spray, stream, or foam pattern of discharge.

A pump piston is inserted into the pump chamber through the pump chamber opening on the sprayer housing. A metal coil spring is typically inserted inside the pump chamber and engages with the pump piston. The pump piston is mounted in the pump chamber for reciprocating movements between charge and discharge positions of the piston in the pump chamber. Moving the piston into the pump chamber to the discharge position compresses the spring, and the liquid in the pump chamber is forced through the liquid discharge passage and out of sprayer housing through the nozzle assembly.

When the piston is moved out of the pump chamber to the charge position by the spring pushing against the piston, a vacuum is created in the pump chamber that draws liquid through the dip tube and through the liquid supply passage into the pump chamber.

A trigger is mounted the sprayer housing for movement of the trigger relative to the sprayer housing. Typically, the trigger pivots relative to the sprayer housing. However, other types of movement are possible. The trigger is operatively connected to the pump piston to cause the reciprocating movements of the pump piston in the pump chamber in response to movements of the trigger.

Inlet and outlet check valves are assembled into the sprayer housing. The inlet check valve controls the flow of liquid through the liquid supply passage to the pump chamber, and prevents the reverse flow of liquid. The outlet check valve controls the flow of the liquid from the pump chamber through the liquid discharge passage, and prevents the reverse flow of liquid.

The typical construction a trigger sprayer described above is comprised of many different component parts. The manufacturing of each of these separate component parts and the assembly of these component parts into the sprayer housing of the trigger sprayer all contribute to the total manufacturing cost of the trigger sprayer. If the number of component parts of the trigger sprayer can be reduced, and if the assembly of the component parts into the sprayer housing of the trigger sprayer can be simplified, the manufacturing cost of the trigger sprayer can be reduced.

SUMMARY OF THE INVENTION

The present invention reduces the number of component parts of a trigger sprayer and simplifies the assembly of the trigger sprayer by providing a single valve member that has an inlet valve element and an outlet valve element, and that is also easily assembled into the sprayer housing. The trigger sprayer also eliminates the metal coil spring and the liquid spinner of conventional trigger sprayers. In this manner, the construction of the trigger sprayer of the invention has a reduced number of component parts, has a simplified assembly, and thereby has reduced manufacturing cost.

The trigger sprayer of the invention has a sprayer housing construction that is similar to that of prior art trigger sprayers. The sprayer housing includes a pump chamber having a cylindrical wall with a center axis and a circular back wall. A liquid supply opening is provided on the sprayer housing, and a liquid supply passage extends through the sprayer housing from the liquid supply opening to the pump chamber. The sprayer housing is formed with an integral cap that attaches to the neck of a separate bottle that contains the liquid to be dispensed by the trigger spray. The cap surrounds the liquid supply opening. A dip tube is inserted into the supply opening. The sprayer housing also includes a liquid outlet opening, and a liquid discharge passage that extends through the sprayer housing from the liquid outlet opening to the pump chamber. A liquid spinner is formed integrally on the sprayer housing in the liquid discharge passage. An air vent chamber is also provided on the sprayer housing adjacent to the pump chamber. A plastic, curved spring is also formed integrally on the sprayer housing.

A nozzle assembly is assembled to the trigger sprayer at the sprayer housing liquid outlet opening. The nozzle assembly works with the liquid spinner to discharge liquid in a spray pattern. Alternatively, the nozzle assembly can be of any known type. Thus, the nozzle assembly could discharge liquid from the trigger sprayer in a spray pattern, or could selectively prevent the discharge of liquid from the trigger sprayer or allow the discharge of liquid in a spray pattern, a stream pattern, or as a foam.

A piston assembly is mounted in the pump chamber for reciprocating movements between charge and discharge positions of the piston assembly relative to the sprayer housing. The piston assembly includes a liquid pump piston and an air vent piston that are mounted for reciprocating movements in the respective liquid pump chamber and air vent chamber. Piston assemblies of this type are known in the art. Other types of liquid pump pistons and air venting assemblies could be employed by the trigger sprayer of the invention.

A manually operated trigger is mounted on the sprayer housing for pivoting movement. The spring on the sprayer housing urges the trigger to pivot away from the sprayer housing. The trigger is operatively connected with the liquid pump piston and air vent piston. In use of the trigger sprayer, the trigger is engaged by the fingers of a user's hand holding the trigger sprayer. Squeezing the trigger causes the trigger to move toward the sprayer housing and compresses the spring. Releasing the squeezing force on the trigger allows the spring to move the trigger away from the sprayer housing. As the trigger is moved toward the sprayer housing the liquid piston is moved toward the charge position in the pump chamber, and as the trigger moves away from the sprayer housing the liquid piston is moved toward the discharge position in the pump chamber, as is conventional.

The novel construction of the trigger sprayer of the invention also includes a cylindrical liquid inlet valve seat surface and a cylindrical liquid outlet valve seat surface. Both of these surfaces are formed on the sprayer housing inside the pump chamber. In addition, the novel construction of the trigger sprayer of the invention includes a single valve member that is easily assembled to the sprayer housing inside the pump chamber. The single valve member has a cylindrical inlet valve element and a cylindrical outlet valve element.

A liquid inlet opening in the back wall of the pump chamber communicates the pump chamber with the liquid supply passage. The cylindrical liquid inlet valve seat surface projects axially from the pump chamber back wall into the pump chamber interior. The liquid inlet valve seat surface is coaxial with the pump chamber center axis and the liquid inlet opening in the back wall of the pump chamber is positioned radially outside of the inlet valve seat surface.

A liquid outlet opening passes through the back wall of the pump chamber and communicates the pump chamber with the liquid discharge passage. The cylindrical liquid outlet valve seat surface projects axially from the pump chamber back wall into the pump chamber interior. The liquid outlet valve seat surface is coaxial with the pump chamber center axis. In addition, the liquid outlet valve seat surface is positioned radially inside the liquid inlet valve seat surface, and the liquid outlet opening in the back wall of the pump chamber is positioned radially inside the outlet valve seat surface.

The valve member of the invention is easily assembled to the sprayer housing inside the pump chamber. The valve member includes a cup-shaped base, a tubular inlet valve element inside the cup-shaped base, and a tubular outlet valve element inside both the inlet valve element and the cup-shaped base. The base and the two valve elements of the valve member are constructed of one piece of a resilient, flexible plastic material that is more resilient and more flexible than the plastic material employed in constructing the sprayer housing and the other component parts of the trigger sprayer.

The cup-shaped base of the valve member has an outer peripheral edge that is dimensioned to seat in a tight sealing engagement against both the back wall of the pump chamber and the cylindrical wall of the pump chamber where the back wall and cylindrical wall meet. The valve member is easily assembled into the pump chamber before the pump piston is inserted into the pump chamber. From the outer peripheral edge, the cup-shaped base extends both axially away from the pump chamber back wall and radially inwardly from the pump chamber cylindrical wall to a center of the cup-shaped base that is coaxial with the pump chamber center axis. A pair of liquid ports are provided through the cup-shaped base on diametrically opposite sides of the pump chamber center axis. The pair of liquid ports communicate both the liquid inlet opening and the liquid outlet opening in the pump chamber back wall with the interior volume of the pump chamber.

The tubular inlet valve element extends axially from the cup-shaped base toward the pump chamber back wall, but stops short of the pump chamber back wall. The inlet valve element is positioned on the cup-shaped base with both of the liquid ports in the base being positioned radially inside the inlet valve element. The inlet valve element has a truncated conical configuration that tapers away from the pump chamber center axis as the valve element extends axially toward the pump chamber back wall. A distal peripheral edge of the inlet valve element engages in a sealing engagement with the cylindrical liquid inlet valve seat surface.

The tubular outlet valve element extends axially from the cup-shaped base toward the pump chamber back wall, but stops short of the back wall. The outlet valve element is positioned on the cup-shaped base with the pair of liquid ports through the base being positioned radially outside the outlet valve element. As the outlet valve element extends axially from the cup-shaped base toward the pump chamber back wall, the valve element tapers radially outward to a distal edge of the valve element. The distal edge of the outlet valve element engages in a sealing engagement with the cylindrical liquid outlet valve seat surface.

On operation of the trigger sprayer of the invention, on movement of the pump piston toward the discharge position in the pump chamber the pump piston increases the pressure of any air in the chamber or exerts a force on any liquid in the chamber. This increase in pressure or force is transmitted through the liquid ports in the cup-shaped base of the valve member to both the tubular inlet valve element and the tubular outlet valve element. The increase in pressure or force in the pump chamber pushes the inlet valve element radially outwardly into a sealing engagement with the cylindrical liquid inlet valve seat surface, and pushes the outlet valve element radially inwardly and out of its sealing engagement with the cylindrical liquid outlet valve seat surface. This allows the air or liquid in the pump chamber to pass through the liquid outlet opening in the back wall of the pump chamber and through the liquid discharge passage and the nozzle assembly from which the air or liquid is discharged.

When the pump piston moves toward the charge position of the piston in the pump chamber, a vacuum is created in the interior of the pump chamber. This vacuum is transmitted through the liquid ports in the cup-shaped base of the valve member to the inlet valve element and the outlet valve element. The vacuum pressure acting on the outlet valve element causes the outlet valve element to flex radially outwardly into a sealing engagement with the cylindrical liquid outlet valve seat surface. This closes off the liquid outlet opening from communicating the liquid discharge passage with the pump chamber interior. Simultaneously, the vacuum created in the pump chamber draws the inlet valve element radially inwardly, disengaging the valve element from the cylindrical liquid inlet valve seat surface. This communicates the liquid inlet opening with the pump chamber interior, and allows liquid to be drawn through the liquid supply passage, through the liquid inlet opening and into the pump chamber interior.

On the subsequent movement of the pump piston back to the discharge position, the liquid previously drawn into the pump chamber is discharged from the pump chamber through the liquid discharge passage and the nozzle assembly in the manner discussed above.

Thus, the trigger sprayer of the invention with the one piece valve member and the elimination of a metal spring and separate liquid spinner reduces the number of component parts of the trigger sprayer giving the trigger sprayer an eight piece construction, and thereby reduces manufacturing and assembly costs associated with the trigger sprayer.

BRIEF DESCRIPTION OF THE DRAWINGS

Further features of the trigger sprayer of the invention are set forth in the following detailed description of the trigger sprayer and in the drawing FIGURE.

DETAILED DESCRIPTION OF THE PREFERRED EMBODIMENT

Figure 1:
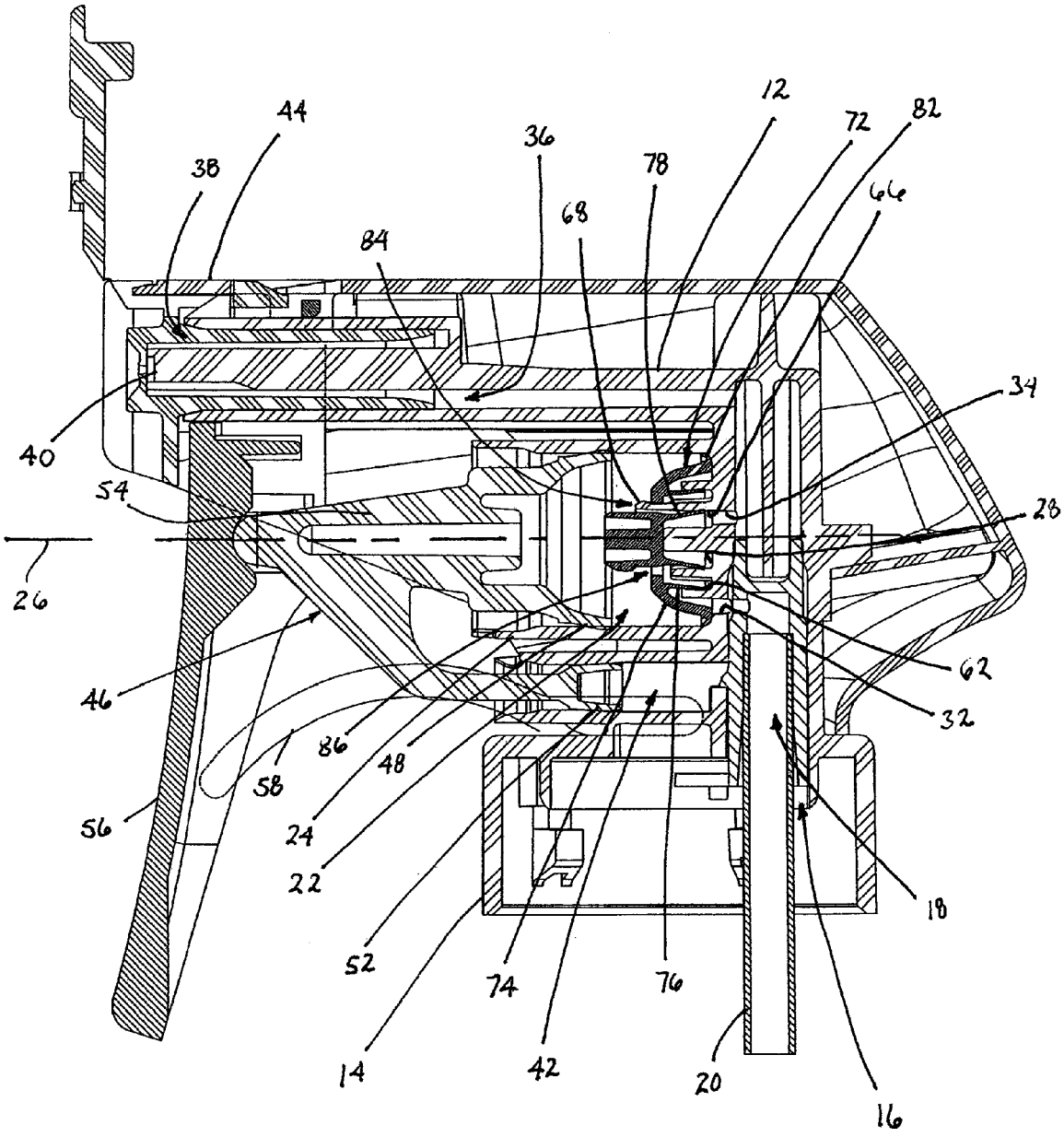
FIG. 1 is a side sectioned view of the trigger sprayer of the invention showing the novel double valve construction of the valve member.

The trigger sprayer of the invention achieves the objectives of reducing the number of component parts of the trigger sprayer and simplifying the assembly of the trigger sprayer by employing a novel single valve member that has both an inlet valve element and an outlet valve element. The valve member of the invention may be employed in most any type of trigger sprayer having a manually manipulated trigger that draws liquid from a bottle attached to the trigger sprayer and discharges the liquid from the trigger sprayer. A large part of the trigger sprayer construction is conventional, and therefore will be described only generally. It should be understood that the construction of the trigger sprayer shown in the drawing figures, apart from the novel features of the invention to be described, is only one example of a trigger sprayer construction in which the valve member of the invention may be employed. Therefore, the particular construction of the trigger sprayer shown and described should not be interpreted as limiting.

The trigger sprayer includes a sprayer housing 12 that has an integral connector cap 14. The cap 14 has a bayonet-type fitment. Other types of caps, for example internally threaded caps that are not integral with the sprayer housing may also be employed. A liquid supply opening 16 is provided on the sprayer housing 12 inside the cap 14. A dip tube 20 is inserted into the liquid supply opening 16, as is conventional. The liquid supply opening 16 communicates through a liquid supply passage 18 with an interior volume 22 of a pump chamber of the sprayer housing. The pump chamber has a cylindrical side wall 24 with a center axis 26. The center axis 26 defines mutually perpendicular axial and radial directions relative to the sprayer housing 12. The pump chamber 22 also has a circular back end wall 28. A liquid inlet opening 32 extends through the back wall 28 and communicates the pump chamber interior volume 22 with the liquid supply passage 18. A liquid outlet opening 34 also extends through the pump chamber back wall 28. As seen in the drawing FIGURE, the liquid outlet opening 34 is positioned in the back wall 28 closer to the pump chamber center axis 26 than the liquid inlet opening 32. The liquid outlet opening 34 communicates the pump chamber interior volume 22 with a liquid discharge passage 36 that extends through the sprayer housing 12 to a discharge opening 38 on the sprayer housing. A liquid spinner 40 is formed integrally with the sprayer housing 12. The liquid spinner 40 is positioned in the liquid discharge passage 36 at the liquid discharge opening 38 of the sprayer housing. The sprayer housing 12 also includes a vent chamber 42. Vent chambers of this type are known in the art.

A nozzle assembly 44 is assembled to the sprayer housing 12 at the liquid discharge opening 38. The nozzle assembly 44 works with the liquid spinner 40 to discharge liquid in a spray pattern. Alternatively, the nozzle assembly 44 can be of any known type. Thus, the nozzle assembly could discharge liquid from the sprayer housing 12 in a spray pattern, or the nozzle assembly 44 could be of a type having a rotatable nozzle cap that selectively prevents the discharge of liquid from the trigger sprayer, or allows the discharge of liquid in a spray pattern, a stream pattern, or as a foam.

A piston assembly 46 is also assembled to the sprayer housing 12. The piston assembly 46 includes both a liquid pump piston 48 and a vent piston 52 that are integral with a piston rod 54. The liquid piston 48 is mounted in the pump chamber volume 22 for reciprocating movements between a charge position and a discharge position of the liquid piston 48 in the pump chamber volume 22, as is conventional. With the integral connection of the piston rod 54 between the liquid piston 48 and the vent piston 52, the vent piston 52 also reciprocates in the vent chamber 42 in response to the reciprocating movements of the liquid piston 48. Other types of liquid pump pistons and air venting assemblies could be employed in the trigger sprayer of the invention.

A manually operated trigger actuator 56 is mounted on the sprayer housing 12. As is conventional, the trigger actuator 56 is mounted for pivoting movement relative to the sprayer housing 12. The trigger actuator 56 is operatively connected to the piston rod 54, and is thereby operatively connected to the liquid pump piston 48 and the vent piston 52. In use of the trigger sprayer, the trigger 56 is engaged by the fingers of a user's hand holding the trigger sprayer. Squeezing the trigger causes the trigger 56 to move toward the sprayer housing 12, and thereby causes the liquid pump piston 48 to move to the discharge position in the interior of the pump chamber 22. Releasing the trigger 56 allows the trigger to move away from the sprayer housing 12, and thereby allows the liquid pump piston 48 to move to the charge position in the interior of the pump chamber 22.

A plastic spring 58 is operatively connected between the trigger actuator 56 and the sprayer housing 12. In the preferred embodiment, the spring is formed integrally with the trigger actuator 56 or the sprayer housing 12. The spring 58 biases the trigger 56 away from the sprayer housing 12, and thereby biases the liquid pump piston 48 toward the charge position of the piston in the interior of the pump chamber 22.

The construction of the trigger sprayer to this point is, apart from the integral construction of the liquid spinner 40 and spring 58 with the sprayer housing 12, conventional. The novel features of the invention are described as being incorporated into the conventional construction of a trigger sprayer, and thereby could be used in most any type of trigger sprayer other than that described above and shown in the drawing FIGURE.

The novel construction of the trigger sprayer of the invention includes a cylindrical liquid inlet valve seat 62 that projects from the back wall 28 of the pump chamber 22. As seen in the drawing FIGURE, the inlet valve seat 62 has a center axis that is coaxial with the pump chamber axis 26. Additionally, the inlet valve seat 62 is positioned on the pump chamber back wall 28 radially inside or closer to the center axis 26 than the liquid inlet opening 32 through the pump chamber back wall 28. An interior surface of the inlet valve seat 62 functions as a seat surface that controls the flow of liquid from the liquid supply passage 18, through the liquid inlet opening 32 and into the pump chamber interior volume 22, and prevents the reverse flow of liquid.

The novel construction of the trigger sprayer of the invention also includes a cylindrical liquid outlet valve seat 66. The outlet valve seat 66 projects axially from the pump chamber back wall 28 into the pump chamber interior volume 22. As seen in the drawing FIGURE, the outlet valve seat 66 is coaxial with the pump chamber center axis 26 and the liquid inlet valve seat 62 and is positioned radially inside of the liquid inlet valve seat 62. In addition, the liquid outlet valve seat 66 extends around the liquid outlet opening 34 in the pump chamber back wall 28. An interior surface of the liquid outlet valve seat 66 functions as a seating surface that controls the flow of liquid from the pump chamber interior 22 through the liquid outlet opening 34 to the liquid discharge passage 36, and prevents the reverse flow of liquid. The majority of the liquid outlet valve seat 66 has a cylindrical configuration, with the exception of a flexible, resilient connecting post 68 that projects axially from the distal end of the outlet valve seat 66.

The novel construction of the trigger sprayer of the invention also includes a single valve member 72 that is assembled to the sprayer housing 12 in the pump chamber interior volume 22. The valve member 72 includes a cup-shaped base 74, a cylindrical or tubular inlet valve element 76 inside the cup-shaped base 74, and a cylindrical or tubular outlet valve element 78 inside both the inlet valve element 76 and the cup-shaped base. The base 74 and the two valve elements 76, 78 are all constructed as one piece of a resilient, flexible plastic material that is more resilient and more flexible than the plastic material employed in constructing the sprayer housing 12 and the other component parts of the trigger sprayer.

The cup-shaped base 74 has a circular outer peripheral edge 82. The edge 82 is pressed into the pump chamber interior volume 22 and seats firmly in a seating engagement between the pump chamber cylindrical side wall 24 and the pump chamber back wall 28. The engagement of the base edge 82 at the merger between the pump chamber side wall 24 and back wall 28 securely positions the valve member 72 inside the pump chamber 22. This provides a tight sealing engagement of the valve member 72 against both the pump chamber side wall 24 and the pump chamber back wall 28. As shown in the drawing FIGURE, the cup-shaped configuration of the base 74 extends axially from the pump chamber back wall 28 and radially inwardly from the pump chamber side wall 24 toward a central portion of the base 74. A pair of liquid ports 84, 86 extend through the central portion of the base 74. The connecting post 64 on the liquid outlet valve seat 66 extends through one of the base ports 84. The engagement of the post 68 in the base port 84 provides a further means of securing the base 74 to its position in the pump chamber interior 22. In addition, both of the liquid ports 84, 86 communicate both the liquid inlet opening 32 and liquid outlet opening 34 in the pump chamber back wall 28 with the interior 22 of the pump chamber.

As shown in the drawing FIGURE, the cylindrical inlet valve element 76 extends axially from the cup-shaped base 74 toward the pump chamber back wall 28, but stops short of the pump chamber back wall 28. The inlet valve element 76 is positioned on the base 74 where the inlet valve element 76 extends around both of the liquid ports 84, 86 through the base. The inlet valve element 76 has a truncated conical configuration that tapers radially away from the pump chamber center axis 26 as the valve element extends axially toward the pump chamber back wall 28. This causes a distal peripheral edge of the inlet valve element 76 from the base 74 to engage in a sealing engagement with the interior seat surface of the liquid inlet valve seat 62.

The cylindrical outlet valve element 78 also extends axially from the cup-shaped base 74 toward the pump chamber back wall 28, but stops short of the back wall. The outlet valve element 78 is positioned on the base 74 with both of the liquid ports 84, 86 through the base 74 being positioned radially outside the cylindrical outlet valve element 78. The outlet valve element 78 also has a truncated conical configuration that tapers radially away from the pump chamber center axis 26 as the valve element extends axially toward the pump chamber back wall 28. This results in a distal peripheral edge portion of the outlet valve element 78 engaging in a sealing engagement with the interior seat surface of the cylindrical liquid outlet valve seat 66.

An operation of the trigger sprayer of the invention, the trigger actuator 56 is manually manipulated in the conventional manner. The trigger actuator 56 is squeezed toward the sprayer housing 12, causing movement of the pump piston 48 in the liquid pump chamber 22 toward the discharge position of the pump piston. This increases the pressure of any air in the pump chamber interior 22, or exerts a force on any liquid in the pump chamber 22. This increase in pressure or force is transmitted through the liquid ports 84, 86 in the cup-shaped base 74 of the valve member 72. The increase in pressure or force acts on both of the cylindrical valve elements 76, 78. This pushes the inlet valve element 76 radially outwardly into a sealing engagement with the cylindrical liquid inlet valve seat 62. Simultaneously, the outlet valve element 78 is pushed radially inwardly by the increasing pressure or force and disengages from its sealing engagement with the cylindrical liquid outlet valve seat 66. This allows the air or liquid in the pump chamber interior 22 to pass through the liquid outlet opening 34 in the pump chamber back wall 28 and through the liquid discharge passage 36 and the nozzle assembly 44 from which the air or liquid is discharged from the trigger sprayer.

When the trigger actuator 56 is released and the spring 58 pushes the trigger actuator 56 away from the sprayer housing 12, the pump piston 48 is moved toward the charge position of the piston in the pump chamber interior 22. This creates a vacuum in the pump chamber interior 22. This vacuum is transmitted through the ports 84, 86 in the cup-shaped base 74 of the valve member 72 and acts on the inlet valve element 76 and the outlet valve element 78. The vacuum pressure acting on the outlet valve element 78 causes the outlet valve element to flex radially outwardly into a sealing engagement with the cylindrical liquid outlet valve seat 66. This closes off the liquid discharge opening 34 from communicating the pump chamber interior 22 with the liquid discharge passage 36. Simultaneously, the vacuum created in the pump chamber interior 22 draws the inlet valve element 76 radially inwardly, disengaging the valve element 76 from the cylindrical liquid inlet valve seat 62. This communicates the pump chamber interior 22 through the liquid inlet opening 32 with the liquid supply passage 18, and allows liquid to be drawn through the liquid supply passage 18, through the liquid inlet opening 32 and into the pump chamber interior 22.

On the subsequent movement of the pump piston 48 back to the discharge position in the pump chamber interior 22, the liquid previously drawn into the pump chamber interior 22 is discharged from the pump chamber through the liquid discharge passage 36 and the nozzle assembly 44 in the manner discussed above.

Thus, the trigger sprayer of the invention with the one piece valve member has a reduced number of component parts and has a more simplified construction than prior art trigger sprayers.

Although the trigger sprayer of the invention has been described above by referring to a particular embodiment of the trigger sprayer, it should be understood that modifications and variations could be made to the construction of the trigger sprayer without departing from the intended scope of the following claims.

What is claimed is:

1. A manually operated trigger sprayer comprising:

a sprayer housing having a liquid supply opening and a liquid discharge opening, a pump chamber in the sprayer housing, the pump chamber having an interior and a liquid inlet opening communicating with the pump chamber interior and a liquid outlet opening communicating with the pump chamber interior;

a liquid supply passage extending through the sprayer housing from the liquid supply opening to the pump chamber liquid inlet opening, and a liquid discharge passage extending through the sprayer housing from the pump chamber liquid outlet opening to the liquid discharge opening;

a pump piston mounted in the pump chamber defining an enclosed interior volume of the pump chamber, the pump piston being mounted for reciprocating movements between charge and discharge positions of the pump piston in the pump chamber where the interior volume of the pump chamber is increased and a vacuum is created in the pump chamber in response to the pump piston moving to the charge position and the interior volume of the pump chamber is decreased and a fluid pressure is created in the pump chamber in response to the pump piston moving to the discharge position; and a single unitary valve member inside the pump chamber interior volume, the valve member having an inlet valve element and an outlet valve element, the inlet valve element being positioned between the pump chamber liquid inlet opening and the pump piston and the outlet valve element being positioned between the pump chamber liquid outlet opening and the pump piston, the inlet valve element and the outlet valve element being resiliently flexible, whereby the inlet valve element flexes away from the liquid inlet opening and opens fluid communication between the liquid supply passage and the pump chamber interior volume and the outlet valve element extends over the liquid outlet opening and closes fluid communication between the pump chamber interior volume and the liquid discharge passage in response to the pump piston moving to the charge position, and the inlet valve element extends over the liquid inlet opening and closes fluid communication between the pump chamber interior volume and the liquid supply passage and the outlet valve element flexes away from the liquid outlet opening and opens fluid communication between the pump chamber interior volume and the liquid discharge passage in response to the pump piston moving to the discharge position, wherein the inlet valve seat surface extends around the outlet valve seat surface.

2. The trigger sprayer of claim 1, further comprising: the valve member having a base that extends around the outlet element and engages with the sprayer housing inside the pump chamber.

3. The trigger sprayer of claim 1, further comprising: the valve member having a hole through the valve member; and, a post on the sprayer housing inside the pump chamber, the post extending through the hole in the valve member and attaching the valve to the sprayer housing.

4. The trigger sprayer of claim 1, further comprising: the pump chamber having a center axis that defines mutually perpendicular axial and radial directions; and, the pump chamber, the pump piston and the inlet valve element and outlet valve element all being coaxial.

5. The trigger sprayer of claim 1, further comprising: the inlet valve seat surface and the outlet valve seat surface being cylindrical surfaces.

6. The trigger sprayer of claim 1, further comprising: the pump chamber having a cylindrical sidewall and a circular end wall; and, the liquid inlet opening and the liquid outlet opening are both in the pump chamber circular end wall.

7. The trigger sprayer of claim 4, further comprising: the sprayer housing having an inlet valve seat surface that is radially adjacent the liquid inlet opening and engages with the inlet valve element when the inlet valve element closes fluid communication between the pump chamber interior volume and the liquid supply passage; and, the sprayer housing having an outlet valve seat surface that extends around the liquid outlet opening and engages with the outlet valve element when the outlet valve element closes fluid communication between the pump chamber interior volume and the liquid discharge passage.

8. A manually operated trigger sprayer comprising:

a sprayer housing having a liquid supply opening and a liquid discharge opening, a pump chamber having a cylindrical sidewall surrounding an interior of the pump chamber, the sidewall having a center axis that defines mutually perpendicular axial and radial directions relative to the trigger sprayer, a liquid inlet opening communicating with the pump chamber interior and a liquid outlet opening communicating with the pump chamber interior, a liquid supply passage extending through the sprayer housing from the liquid supply opening to the liquid inlet opening, and a liquid discharge passage extending through the sprayer housing from the liquid outlet opening to the liquid discharge opening;

a pump piston mounted in the pump chamber defining an enclosed interior volume of the pump chamber, the pump piston being mounted in the pump chamber for reciprocating movements between charge and discharge positions of the pump piston in the pump chamber where the interior volume of the pump chamber is increased and a vacuum is created in the pump chamber in response to the pump piston moving to the charge position and the interior volume of the pump chamber is decreased and a fluid pressure is created in the pump chamber in response to the pump piston moving to the discharge position;

a resiliently flexible inlet valve element positioned in the pump chamber interior between the pump chamber liquid inlet opening and the pump piston where the inlet valve element flexes radially toward the pump chamber center axis and opens fluid communication between the liquid supply passage and the pump chamber interior volume in response to the pump piston moving to the charge position; and, a resiliently flexible outlet valve element positioned in the pump chamber interior between the pump chamber liquid outlet opening and the pump piston where the outlet valve element flexes radially toward the pump chamber center axis and opens fluid communication between the liquid discharge passage and the pump chamber interior volume in response to the pump piston moving to the discharge position.

9. The trigger sprayer of claim 8, further comprising: the inlet valve element blocking fluid communication between the pump chamber interior and the liquid inlet opening in response to the pump piston moving to the discharge position; and, the outlet valve element blocking fluid communication between the pump chamber interior and the liquid outlet opening in response to the pump piston moving to the charge position.

10. The trigger sprayer of claim 8, further comprising: the inlet valve element having an at rest position blocking fluid communication between the liquid inlet opening and the pump chamber interior and the outlet valve element having an at rest position blocking fluid communication between the liquid outlet opening and the pump chamber interior in response to the pump piston being stationary in the pump chamber.

11. The trigger sprayer of claim 8, further comprising: the pump chamber sidewall, the inlet valve element, and the outlet valve element all being coaxial.

12. The trigger sprayer of claim 8, further comprising: the sprayer housing having an inlet valve seat surface that is radially adjacent the liquid inlet opening and engages with the inlet valve element when the inlet valve element closes fluid communication between the pump chamber interior volume and the liquid supply passage; and, the sprayer housing having an outlet valve seat surface that extends around the liquid outlet opening and engages with the outlet valve element when the outlet valve element closes fluid communication between the pump chamber interior volume and the liquid discharge passage.

13. The trigger sprayer of claim 8, further comprising: the pump chamber having a cylindrical sidewall and a circular end wall; and, the liquid inlet opening and the liquid outlet opening are both in the pump chamber circular end wall.

14. The trigger sprayer of claim 12, further comprising: the inlet valve seat surface extending around the outlet valve seat surface.

15. The trigger sprayer of claim 14, further comprising: the inlet valve seat surface and the outlet valve seat surface being cylindrical surfaces.

16. A manually operated trigger sprayer comprising:

a sprayer housing having a liquid supply opening and a liquid discharge opening, a pump chamber having a cylindrical sidewall surrounding an interior of the pump chamber, the sidewall having a center axis that defines mutually perpendicular axial and radial directions relative to the trigger sprayer, a liquid inlet opening communicating with the pump chamber interior and a liquid outlet opening communicating with the pump chamber interior, a liquid supply passage extending through the sprayer housing from the liquid supply opening to the liquid inlet opening, a liquid discharge passage extending through the sprayer housing from the liquid outlet opening to the liquid discharge opening, an inlet valve seat surface radially adjacent the liquid inlet opening, and an outlet valve seat surface extending around the liquid outlet opening;

a pump piston mounted in the pump chamber and defining an enclosed interior volume of the pump chamber, the pump piston being movable in the pump chamber in reciprocating movements between charge and discharge positions of the pump piston in the pump chamber where the pump chamber interior volume is increased and a vacuum is created in the pump chamber in response to the pump piston moving to the charge position and the pump chamber interior volume is decreased and a fluid pressure is created in the pump chamber in response to the pump piston moving to the discharge position;

a resiliently flexible, tubular inlet valve element positioned in the pump chamber interior where the tubular inlet valve engages against the inlet valve seat surface and blocks communication between the pump chamber interior and the liquid inlet opening in response to the pump piston moving to the discharge position, and where the tubular inlet valve disengages from the inlet valve seat surface and opens communication between the pump chamber interior and the liquid inlet opening in response to the pump piston moving to the charge position; and, a resiliently flexible, tubular outlet valve element positioned in the pump chamber interior where the tubular outlet valve engages against the outlet valve seat surface and blocks communication between the pump's chamber interior and the liquid outlet opening in response to the pump piston moving to the charge position, and where the tubular outlet valve disengages from the outlet valve seat surface and opens communication between the pump interior and the liquid outlet opening in response to the pump piston moving to the discharge position.

17. The trigger sprayer of claim 16, further comprising: the tubular inlet valve element and the tubular outlet valve element being coaxial.

18. The trigger sprayer of claim 16, further comprising: the tubular inlet valve element and the tubular outlet valve element having coincident axes.

19. The trigger sprayer of claim 16, further comprising: the tubular outlet valve element being positioned inside the tubular inlet valve element.

20. The trigger sprayer of claim 16, further comprising: the inlet valve seat surface being a cylindrical surface and the outlet valve seat surface being a cylindrical surface.

21. The trigger sprayer of claim 16, further comprising: the inlet valve seat surface being a cylindrical interior surface and the outlet valve seat being a cylindrical interior surface.

22. The trigger sprayer of claim 16, further comprising: the pump chamber having a cylindrical sidewall and a circular back wall; and, the liquid inlet opening and the liquid outlet opening are both in the pump chamber circular back wall.

23. The trigger sprayer of claim 21, further comprising: the tubular inlet valve element flexing radially inwardly away from the cylindrical interior inlet valve seat surface in response to the pump piston moving to the charge position; and, the tubular outlet valve element flexing radially inwardly away from the cylindrical interior outlet valve seat surface in response to the pump piston moving to the discharge position.

24. The trigger sprayer of claim 21, further comprising: the pump chamber having a cylindrical sidewall and a circular back wall; and, the liquid inlet opening and the liquid outlet opening are both in the pump chamber circular back wall.

25. The trigger sprayer of claim 24, further comprising: the cylindrical interior inlet valve seat surface projecting axially from the pump chamber back wall; and, the cylindrical interior outlet valve seat surface projecting axially from the pump chamber back wall.

* * * * *